US007200539B2

(12) United States Patent
Ong et al.

(10) Patent No.: US 7,200,539 B2
(45) Date of Patent: Apr. 3, 2007

(54) METHOD OF PREDICTING THE ON-SET OF FORMATION SOLID PRODUCTION IN HIGH-RATE PERFORATED AND OPEN HOLE GAS WELLS

(75) Inventors: See Hong Ong, Sugar Land, TX (US); Gangerico G. Ramos, Allen, TX (US); Ziqiong Zheng, Sugar Land, TX (US)

(73) Assignee: Baker Hughes Incorporated, Houston, TX (US)

( * ) Notice: Subject to any disclaimer, the term of this patent is extended or adjusted under 35 U.S.C. 154(b) by 1014 days.

(21) Appl. No.: 09/790,151

(22) Filed: Feb. 21, 2001

(65) Prior Publication Data

US 2002/0147574 A1 Oct. 10, 2002

(51) Int. Cl.

| | |
|---|---|
| ***G06G 7/48*** | (2006.01) |
| ***E21B 47/01*** | (2006.01) |
| ***G01V 1/40*** | (2006.01) |
| *E21B 47/00* | (2006.01) |

(52) U.S. Cl. ..... 703/9; 166/250.01; 702/6; 703/10

(58) Field of Classification Search ..... 703/10, 703/9; 166/254.2, 401, 370, 250.01; 73/152.02, 73/152.29, 152.05, 152.11
See application file for complete search history.

(56) References Cited

U.S. PATENT DOCUMENTS

| | | | | |
|---|---|---|---|---|
| 3,563,311 A | | 2/1971 | Stein | |
| 4,240,287 A | | 12/1980 | Mast et al. | |
| 4,623,021 A | | 11/1986 | Stowe | |
| 4,926,942 A | | 5/1990 | Profrock, Jr. | |
| 5,360,066 A | | 11/1994 | Venditto et al. | |
| 5,497,658 A | | 3/1996 | Fletcher et al. | |
| 5,597,042 A | * | 1/1997 | Tubel et al. | 166/250.01 |
| 5,612,493 A | | 3/1997 | Alexander | |
| 7,066,019 B1 | * | 6/2006 | Papanastasiou | 73/152.59 |

OTHER PUBLICATIONS

Wang et al ("The Prediction of Operating Conditions to Constrain Sand Production from a Gas Well", paper SPE 21681, presented at the Production Operations Symposium, Apr. 7-9, 1991).*
The Title Unit, (The Title Unit, "Microsoft Excel 97 Part One", College On-Line Tutorials for Common Computer Applications, Canterbury Christ Church University, 1999), http://www2.ctcnet.org/ctc/C3uc/excel97prt1.pdf.*

(Continued)

*Primary Examiner*—Anthony Knight
*Assistant Examiner*—Tom Stevens
(74) *Attorney, Agent, or Firm*—Madan, Mossman & Sriram, P.C.

(57) ABSTRACT

A method for predicting the on-set of sand production or critical drawdown pressure (CDP) in high flow rate gas wells. The method describes the perforation and open-hole cavity stability incorporating both rock and fluid mechanics fundamentals. The pore pressure gradient is calculated using the non-Darcy gas flow equation and coupled with the stress-state for a perfectly Mohr-Coulomb material. Sand production is assumed to initiate when the drawdown pressure condition induces tensile stresses across the cavity face. Both spherical and cylindrical models are presented. The spherical model is suitable for cased and perforated applications while the cylindrical model is used for a horizontal open-hole completion.

12 Claims, 12 Drawing Sheets

OTHER PUBLICATIONS

Weingarten et al, "Prediction of Sand Production in Gas Wells: Method and Gulf of Mexico Case Studies", paper SPE 24797, presented at the 67th Annual Technical Conference and Exhibition, Oct. 4-7, 1992.*

"Computer Optimization of Continuous Flow Gas Lift Design" 1990. SH Ong. University of Oklahoma, p. 1-202.*

"Borehole Stability" SH Ong.SH Ong. University of Oklahoma, p. 1-344.*

Bambie et al., "Analysis of Commingled Gas Reservoirs with Variable Bottom-Hole Flowing Pressure and Non-Darcy Flow" 1997 Society of Patroleum Enginers Inc. p. 1-13.*

Ong et al., "Sand Production Prediction in High Rate, Perforated and Open-hole Gas Wells", Society of Petroleum Engineers Inc., SPE 58721, pp. 1-9.

Raaen et al., "FORMEL: A Step Forward in Strength Logging", Society of Petroleum Engineers Inc., SPE 36533, pp. 439-445.

"Sand Production Prediction in High Rate, Perforated and Open-Hole Gas Wells", Seehong Ong, G. G. Ramos and Ziqiong Zheng; Society of Petroleum Engineers, SPE 58721, pp. 1-10.

"FORMEL: A Step Forward in Strength Logging", A. M. Raaen, K. A. Havem, H. Joranson and E. Fjaer; Society of Petroleum Engineers, SPE 36533, pp. 439-445.

G.R. Coates et al., Mechanical Properties Program Using Borehole Analysis and Mohr's Circle, SPWLA Twenty -Second Annual Logging Symposium, Jun. 23-26, 1981, pp. 1-17.

R.A. Farquhar et al., Porosity As A Geomechanical Indicator: An Application Of Core And Log Data And Rock Mechanics, SPE 28853, European Petroleum Conference, London, UK, Oct. 25-27, 1994, pp. 481-489.

G.G. Ramos, Sand Production In Vertical And Horizontal Wells In A Friable Sandstone Formation, North Sea, SPE 28065, SPE/ISRM Rock Mechanics in Petroleum Engineering Conference, Delft, The Netherlands, Aug. 29-31, 1994, pp. 309-315.

J.P. Sarda et al., Use of Porosity As A Strength Indicator For Sand Production Evaluation, SPE 26454, 68th Annual Techincal Conference and Exhibition of the Society of Petroleum Engineers, Houston, Texas, Oct. 3-6, 1993, pp. 381-388.

X.M. Tang et al., Joint Interpretation Of Formation Permeability From Wireline Acoustic, NMR, And Image Log Data, SPWLA 39th Annual Logging Symposium, May 26-29, 1998, pp. 1-14.

Z. Wang et al., The Prediction Of Operating Conditions To Constrain Sand Production From A Gas Well, SPE 21681, Production Operations Symposium, Oklahoma City, Oklahoma, Apr. 7-9, 1991, pp. 447-465.

J.S. Weingarten et al., Prediction of Sand Production In Gas Wells: Methods And Gulf Of Mexico Case Studies, SPE 24797, 67th Annual and Technical Conference and Exhibition Of The Society of Petroleum Engineers, Washington D.C., Oct. 4-7, 1992, pp. 317-324.

M.R.J. Wyllie et al., Some Theoretical Considerations Related To The Quantitative Evaluation Of The Physical Charateristics Of Reservoir Rock From Electrical Log Data, T.P. 2852, vol. 189, 1950, pp. 105-118.

* cited by examiner

| CDP Input Parameters | |
|---|---|
| $\mu$ | 0.00218 cp |
| $m$ | 0.911 |
| $\gamma$ | 0.0063 $lbm/ft^3/(psi)^m$ |
| $a$ | 0.5 in |
| $b$ | 1320 ft |
| $H$ | 130 ft |
| $D$ | 8.5 in |

FIG. 12

METHOD OF PREDICTING THE ON-SET OF FORMATION SOLID PRODUCTION IN HIGH-RATE PERFORATED AND OPEN HOLE GAS WELLS

BACKGROUND OF THE INVENTION

1. Field of the Invention

This invention relates generally to the completion of gas wells and more particularly to a method of predicting the on-set of solids production in high flow rate gas wells.

2. Description of the Related Art

High-rate gas well completions are common practice in offshore developments and among some of the most prolific gas fields in the world. These fields typically have reservoirs that are highly porous and permeable but weakly consolidated or cemented, and sand production is a major concern. Because of the high gas velocity in the production tubing, any sand production associated with this high velocity can be extremely detrimental to the integrity of surface and downhole equipment and pose extreme safety hazards. Prediction of a maximum sand free production rate is therefore critical, not only from a safety point of view but also economically. The unnecessary application of sand control techniques, as a precaution against anticipated sand production, can cause an increase in completion costs and a possible reduction in well productivity. However, if operating conditions dictate the need for sand exclusion, such techniques can make a well, which otherwise could have been abandoned or not developed, extremely profitable.

As gas flows through a perforation cavity or through a horizontal borehole, the gas pressure in the flow passage is less than the gas pressure in the formation pores. The greater the difference between the two pressures, the higher the flow rate. This difference is called the drawdown pressure. Two mechanisms responsible for sand production are compressive and tensile failures of the formation surrounding the perforation cavity or horizontal borehole. Compressive failure refers to tangential stresses near the cavity wall exceeding the compressive strength of the formation. Both stress concentration and fluid (liquid or gas) withdrawal can trigger this condition. Tensile failure refers to tensile stress triggered exclusively by drawdown pressure exceeding the tensile failure criterion. Tensile failures predominate in unconsolidated sands and compressive failures in consolidated sandstone. The near borehole stresses cause desegregation of the formation while the fluid drag forces provide the medium to remove the failed materials. The drawdown pressure at which the formation begins to fail and produce sand is called the critical drawdown pressure (CDP). The ability to accurately predict CDP is critical to optimizing the well completion strategy.

For CDPs in gas wells, an analytical spherical cavity stability model that considers the pressure dependent density for a non-ideal gas has been proposed: see Weingarten, J. S., and Perkins, T. K.: "Prediction of Sand Production in Gas Wells: Method and Gulf of Mexico Case Studies", paper SPE 24797 presented at the $67^{th}$ Annual Technical Conference and Exhibition, Oct. 4–7, 1992. This model assumes a steady state Darcy's seepage force with the Mohr-Coulomb yield criterion to establish the pressure gradient near the cavity face. The maximum permissible, or critical, drawdown is arrived at by limiting the net tensile stresses at the cavity wall to zero. Because this tensile model assumes only Darcy's flow regime, its use is limited to low-rate gas well applications. One of the characteristics of a high gas-rate flow in the reservoir is the deviation from Darcy flow in describing the pressure gradients over the whole range of fluid interstitial velocity. This is especially true in a limited region around the wellbore where the pressure drawdown is high and the gas velocity can become so large that, in addition to the viscous force component represented by Darcy's law, there is also an additional force due to the acceleration and deceleration of the gas particles, referred to as the non-Darcy component.

Another approach proposed a cavity stability predictive model that incorporates the effects of non-Darcy flow for a cylindrical perforation tunnel: see Wang, Z., Peden, J. M., and Damasena, E. S. H.: "The Prediction of Operating Conditions to Constrain Sand Production from Gas Well", paper SPE 21681 presented at the Production Operations Symposium, Apr. 7–9, 1991. The analytical model uses a gas flow model to calculate the pore pressure distribution associated with various production conditions, while a stress model with pore pressure input evaluated from the gas flow model is used for the determination of the stress and strain distributions. The stability of a perforation is assessed when the equivalent plastic strain has reached a certain critical value. The results from this non-coupled, compressive failure model suggest that non-Darcy flow has far more effect on the perforation cavity instability than Darcy flow, particularly in the case of weakly consolidated rocks.

SUMMARY OF THE INVENTION

This invention provides a method, which includes the influence of non-Darcy flow, for predicting the maximum permissible, or critical, drawdown pressure in high rate gas wells. A continuous profiling of critical drawdown with depth allows a quick identification of potential sand producing zones and provides guidelines for maximum drawdown or flow rates. It is also useful for developing an optimum selective perforation strategy.

Both spherical and cylindrical models are used. The spherical model is suitable for cased and perforated applications while the cylindrical model is used to predict the sanding tendency of a horizontal open-hole completion. Static reservoir mechanical properties and strength are required. For a perfectly Mohr-Coulomb solid, the cohesive strength and internal frictional angle characterize the rock strength of the formation.

In one embodiment, a log-based model is used to determine static rock mechanical properties including cohesive strength and internal friction angle on an approximately foot by foot basis. Likewise, formation flow parameters of permeability and porosity are determined from well logs and are used with a correlative model to determine non-Darcy flow coefficients. Formation gas properties are determined from experimental tests or from established correlative charts. The data are input into an analytical model to determine the critical drawdown pressure on a predetermined interval basis, typically, a foot by foot basis. The critical drawdown pressure is output in graphical or tabular form.

In another embodiment, experimental core results are used to predict the static rock mechanical properties.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein:

FIG. 12 is a table of example input parameters for calculating critical drawdown pressure according to one embodiment of the present invention.

DESCRIPTION OF PREFERRED EMBODIMENTS

Figure 1:
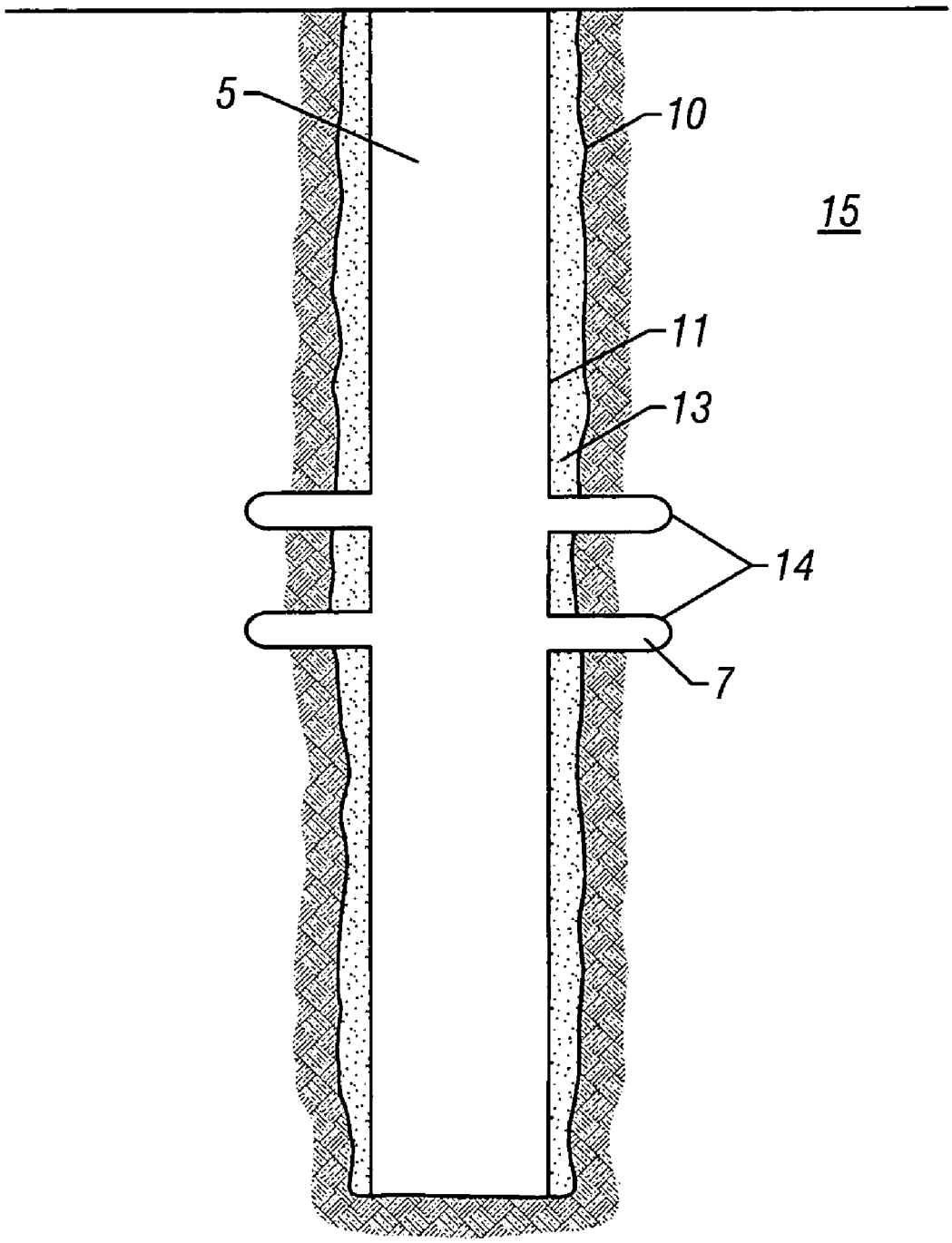
FIG. 1 PRIOR ART
FIG. 1 is a schematic of a cased well which is completed into a subterranean, hydrocarbon producing formation.

FIG. 1 is a schematic of a well 10 which is completed into a subterranean, hydrocarbon producing formation 15. The wellbore 5 of well 10 has a casing 11 cemented in place and both casing 11 and cement 13 have been perforated with perforations 14 which extend into the formation 15 generating a perforation cavity 7 and provide fluid communication between the formation 15 and the wellbore 5.

Figure 2:
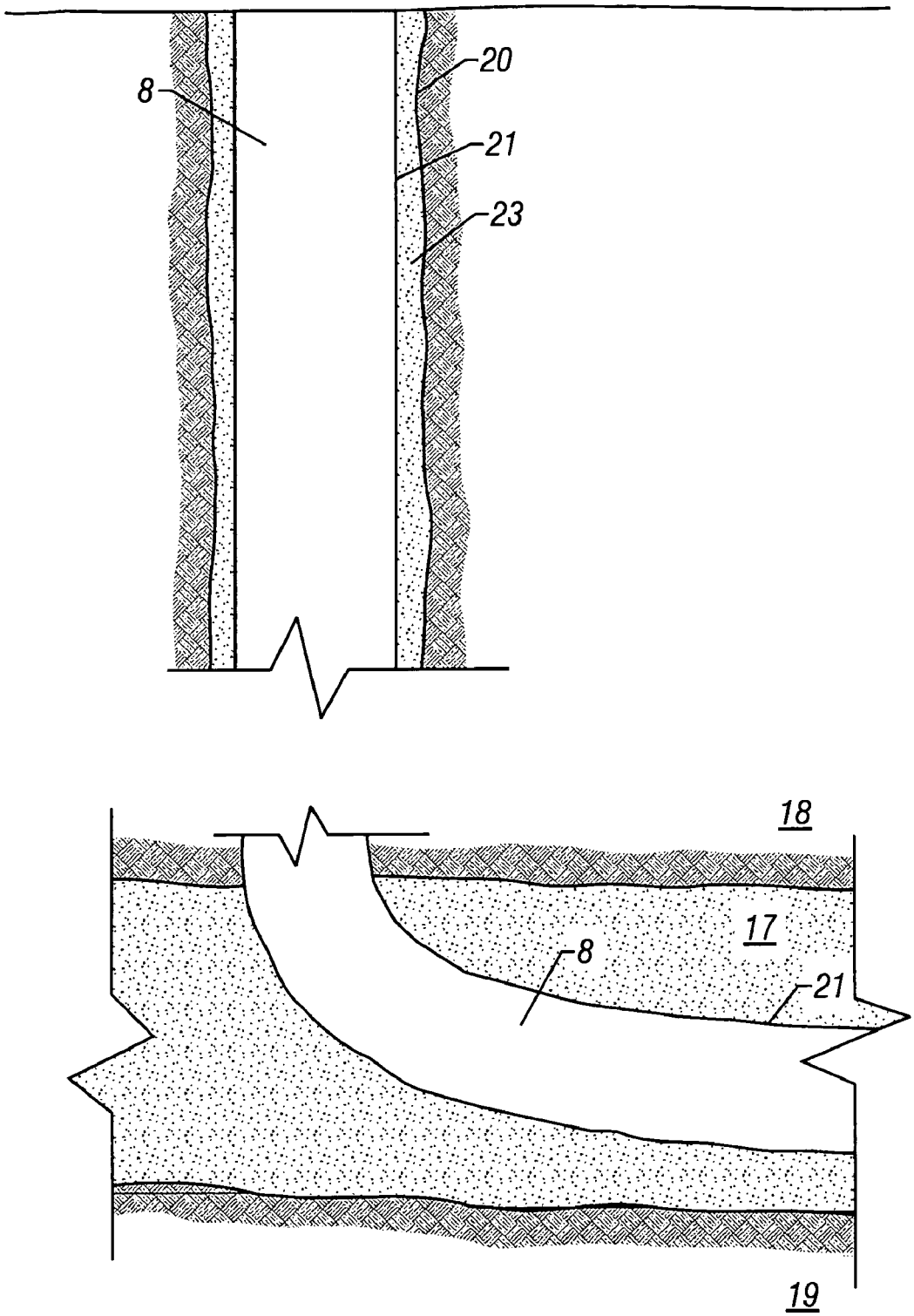
FIG. 2 PRIOR ART
FIG. 2 is a schematic of a well which is deviated to run essentially horizontal in a subterranean, hydrocarbon producing formation which is bounded above and below by relatively impermeable formations.

FIG. 2 is a schematic of a well 20 which is deviated to run essentially horizontally in a subterranean, hydrocarbon producing formation 17 bounded above and below by relatively impermeable formations 18 and 19. The well 20 is intended to be completed in the horizontal, open-hole portion of wellbore 8. Alternatively, the well 20 may be completed using a slotted liner (not shown) in the horizontal section. The treatment of the flow within the reservoir is the same for either the open hole or the slotted liner completion cases.

Perforation Cavity Stability

Figure 3:
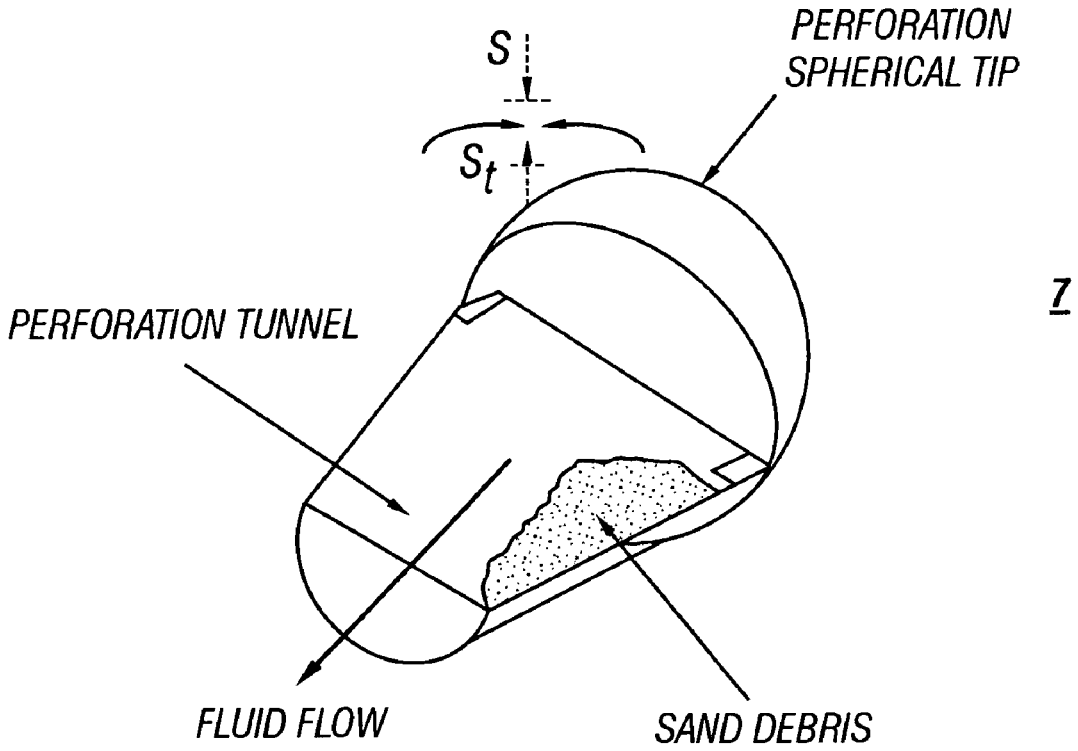
FIG. 3 PRIOR ART
FIG. 3 show a schematic of a perforation cavity.

FIG. 3 shows a schematic of a perforation cavity 7 with tangential and radial element stresses, $S_t$ and $S_r$, respectively (see Nomenclature Table for symbol definitions). The loss of radial support and the redistribution of stresses around the cavity 7 as a result of a perforating operation in a stressed environment can potentially destabilize the cavity. If the unloading of the radial element stress $S_r$, is such that $S_t-S_r$, is sufficiently large to reach the yield stress of the material, plastic yielding will develop. It is well known in the art that for a perfectly Mohr Coulomb material, the relationship between $S_t$ and $S_r$, at the limit of shear stability can be expressed as:

$$S_r - S_t = -\left(\frac{2\sin\alpha}{1-\sin\alpha}\right)[S_r - P + S_o\cot\alpha]. \tag{1}$$

To maintain mechanical stability, the force balance equation must be satisfied, i.e., $$\frac{dS_r}{dr} + \frac{C(S_r - S_t)}{r} = 0. \tag{2}$$

where C=2 and C=1 for spherical and cylindrical geometry, respectively. Substituting Eq. 1 into Eq. 2 and expressing the resulting equation in terms of effective stress, the expression describing the mechanical stability around a perforation cavity is:

$$\frac{dy}{dx} = F\left(\frac{y+1}{x}\right) - \frac{d}{dx}\left(P\frac{\tan\alpha}{S_o}\right). \tag{3}$$

where F takes the form of:

$$F = \frac{2C\sin\alpha}{1-\sin\alpha}. \tag{4}$$

and the transformations:

$$y = \frac{\sigma_r\tan\alpha}{S_o},\ x = \frac{r}{a}. \tag{5}$$

have been adopted to derive Eq. 3.

For a steady-state seepage into a perforation cavity 7, it is known in the art that the pressure gradient necessary to sustain flow over the whole range of velocity is given by the Forcheimer equation, which when expressed in terms of mass flow rate takes the form of:

$$\frac{dP}{dr} = \frac{\mu G}{kA\rho} + \frac{\beta}{\rho}\left(\frac{G}{A}\right)^2. \tag{6}$$

where μ is the average gas viscosity over the pressure interval, and k is assumed to be non-pressure dependent. For a non-ideal gas, it is known in the art that the density variation over a range of pressure can be modeled using a power law relationship:

$$\rho=\gamma P^m \tag{7.}$$

Substituting Eq. 7 into Eq. 6 and integrating the resulting equation leads to an explicit expression of the mass flow rate. By equating the mass flow rate at outer reservoir boundary to mass flow rate at any radius r, an explicit expression P(r) is obtained, which when substituted into Eq. 3 results in the following expressions:

With Cylindrical Symmetry (Horizontal Open-hole):

$$\frac{dy}{dx} = F\left(\frac{y+1}{x}\right) - \frac{\frac{C_1}{x} + \frac{C_2}{x^2}}{m+1}\left[q_a + C_1\ln(x) + C_2\left(1 - \frac{1}{x}\right)\right]^{\frac{m}{m+1}}. \tag{8}$$

where:

$$C_1 = \frac{2\left(\sqrt{1 + h_c(q_b - q_a)} - 1\right)}{h_c\ln\left(\frac{b}{a}\right)}. \tag{9}$$

$$C_2 = \frac{1}{h_c\left(1 - \frac{a}{b}\right)}\left(\sqrt{1 + h_c(q_b - q_a)} - 1\right)^2. \tag{10}$$

$$h_c = \frac{4k^2\beta\gamma\left(1 - \frac{a}{b}\right)}{a(m+1)\left[\mu\ln\left(\frac{b}{a}\right)\right]^2}\left(\frac{S_o}{\tan\alpha}\right)^{m+1}. \tag{11}$$

With Semi-Spherical Symmetry (Perforation Tip):

$$\frac{dy}{dx} = F\left(\frac{y+1}{x}\right) - \frac{\frac{S_1}{x^2} + \frac{3S_2}{x^4}}{m+1}\left[q_a + S_1\left(1 - \frac{1}{x}\right) + S_2\left(1 - \frac{1}{x^3}\right)\right]^{\frac{m}{m+1}}. \tag{12}$$

where:

$$S_1 = \frac{2\left(\sqrt{1 + h_s(q_b - q_a)} - 1\right)}{h_s\left(1 - \frac{a}{b}\right)}. \tag{13}$$

$$S_2 = \frac{1}{h_s\left(1 - \frac{a^3}{b^3}\right)}\left(\sqrt{1 + h_s(q_b - q_a)} - 1\right)^2. \tag{14}$$

$$h_s = \frac{4k^2\beta\gamma\left(1 - \frac{a^3}{b^3}\right)}{3a(m+1)\left[\mu\left(1 - \frac{a}{b}\right)\right]^2}\left(\frac{S_o}{\tan\alpha}\right)^{m+1}. \tag{15}$$

Across the sand-face, the pressure gradients may be expressed in terms of the pressures at two points, $P_a$ and $P_b$, and pressure constants, $q_a$ and $q_b$ are defined as:

$$q_a = \left(\frac{P_a\tan\alpha}{S_o}\right)^{m+1},\ q_b = \left(\frac{P_b\tan\alpha}{S_o}\right)^{m+1}. \tag{16}$$

A critical value of the pressure difference or drawdown ($P_b$–$P_a$) may be solved in terms of geometrical and fluid properties. Physically, when a fluid flows towards a cavity, tensile net stresses tend to be induced near the cavity face if the flow rate is sufficiently large. At the periphery of the cavity, the net radial stress is zero. Tensile stress can be induced only if $d\sigma_r/dr<0$ (tensile stresses are negative) at r=a. A conservative design criterion for cavity stability is to limit the drawdown to those values, which could not induce tensile net stresses. Thus in order to avoid net tensile stresses near the cavity face, the largest permissible drawdown is that value which makes $d\sigma_r/dr<0$ at r=a. This condition can also be written as dy/dx=0 at x=1. From Eq. 8 and Eq. 12, noting that y=0 (net radial stress is zero) at the cavity wall (x=1), the condition of imminent failure are as follows:

For the Cylindrical Cavity (Open-hole)

$$\frac{C_1 + C_2}{m+1}(q_a)^{-\frac{m}{m+1}} = \frac{2\sin\alpha}{1 - \sin\alpha}. \tag{17}$$

For the Spherical Tip (Perforation)

$$\frac{S_1 + 3S_2}{m+1}(q_a)^{-\frac{m}{m+1}} = \frac{4\sin\alpha}{1 - \sin\alpha}. \tag{18}$$

The CDP is obtained by finding a value of $P_a$ that satisfies either Eq. 17 or Eq. 18, which also show that the maximum sustainable fluid gradients depend on formation strength properties, permeability and fluid characteristics.

Formation Mechanical Properties

In the development of the critical drawdown models, the formation at the periphery of the perforation cavity was assumed to be at the limit of elastic stability defined by the Mohr-Coulomb failure criterion. As is known in the art, for a perfectly Mohr-Coulomb material, the failure criterion can be written as:

$$\tau = S_o + \sigma_n \tan\alpha \tag{19.}$$

Traditionally, the cohesive strength and internal friction angle are obtained by conducting a series of triaxial compression tests and by plotting the Mohr circles in the τ–σ space to define the rock strength parameters. However, rock mechanics laboratory tests only provide mechanical properties at discrete core depths along the profile of the wellbore. Many field applications require a continuous presentation of mechanical properties with depth. To overcome this shortfall, many log-based mechanical property prediction models have evolved: see Coates, G. R., and Denoo, S. A.: "Mechanical Properties Program using Borehole Analysis and Mohr's Circle", paper DD presented at SPWLA 22$^{nd}$ Annual Logging Symposium, 1992; Sarda, J.-P., Kessler, N., Wicquart, E., Hannaford, K., and Deflandre, J.-P.: "Use of Porosity as a Strength Indicator for Sand Production Evaluation", paper SPE 26454 presented at 68$^{th}$ Annual Technical Conference and Exhibition, Oct. 3–6, 1993; Farquhar, R. A., Sommerville, J. M., and Smart, B. G. D.: "Porosity as a Geomechanical Indicator: An Application of Core and Log data and Rock Mechanics", paper SPE 28853 presented at the Europen Petroleum Conference, Oct. 25–27, 1994. To effectively use these correlations for local environments, calibration with core data should be carried out, as studies have indicated that correlations that have been calibrated with core data are better than correlations without calibrated parameters. This implies that a large core data set must be made available, which in many instances is lacking due to costs involved andlor the lack of suitable core materials. Since log data are available in most wells, a direct computation of static mechanical properties from log inputs is preferred.

In a preferred embodiment, static mechanical properties and strength are generated using a Logging of Mechanical Properties (LMP) program. LMP uses a model such as FORMEL, which is a constitutive model describing the microscopic processes occurring in a rock sample during mechanical loading; see Raaen, A. M., Hovem, K. A., Joranson, H., and Fjaer, E.: "FORMEL: A Step Forward in Strength Logging", paper SPE 36533 presented at the 71st Annual Technical Conference and Exhibition, Oct. 6–9, 1996. Essentially, the model utilizes the fundamental relationship between static and dynamic behavior to construct the constitutive relationship between stress and strain for a given rock material. The difference in static and dynamic moduli is partly caused by the fluid effects, but mainly attributed to the fact that certain mechanisms require large strain amplitude to be activated. These mechanisms include the crushing of grain contacts, pore collapse and shear sliding along the internal surfaces. During a small amplitude dynamic loading excited by an acoustic wave, these mechanisms are not activated. Thus, by separating deformations due to internal surface sliding, pore and grain deformations and dilatancy with those deformations under dynamic loading, relationships between static and dynamic properties can be derived.

Figure 4:
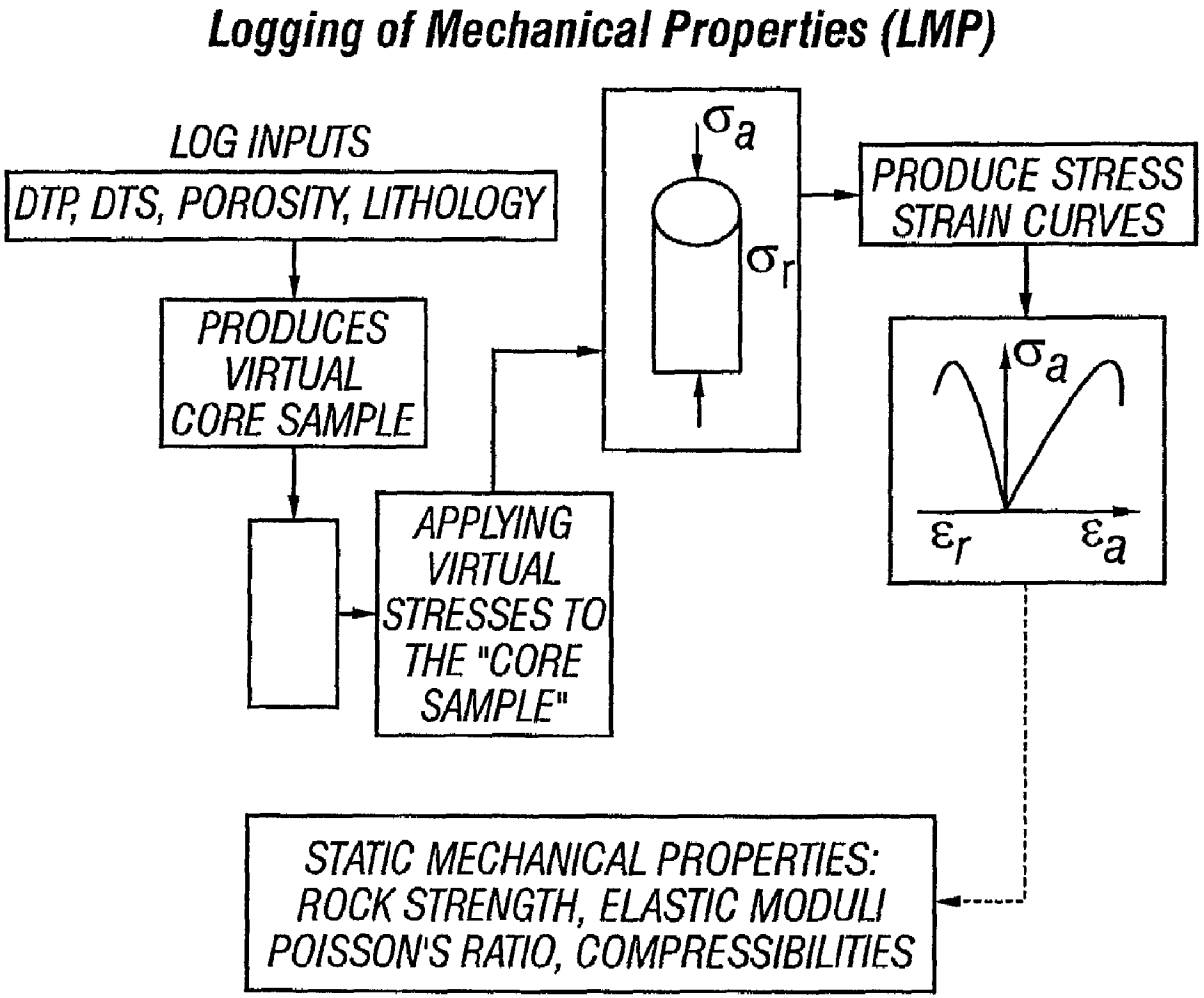
FIG. 4 shows a schematic flow diagram of a method for determining rock mechanical properties using log data according to one embodiment of the present invention.

From theoretical analyses and experimental studies, the relationships between rock porosity, bulk density, mineral content, dynamic properties and grain contact parameter, sliding crack parameter, and dilatancy parameter have been established and documented in calibration tables. As shown schematically in FIG. 4, using fluid and rock properties from logs (saturation, lithology density, compressional and shear slowness) as inputs, a representative rock sample for a given depth can be theoretically reconstructed from these calibration tables, and the constitutive behavior of the rock sample can be examined with simulated hydrostatic and triaxial loading. Incremental strains as a result of incremental stresses are calculated and stress-strain curves under static loading can be constructed. Using techniques known in the art, static mechanical properties can then be derived from the stress-strain curves and the strength of a rock sample can be obtained from the maximum value of the stress that could be applied to the rock sample prior to failure. Because the virtual core sample can be tested under any given confining pressure levels, Mohr circles (and hence the failure envelope) can be constructed to derive the cohesive strength and internal friction angle of the rock.

Formation Petrophysical Properties

In addition to formation strength characteristics, the critical drawdown model also requires formation permeability and non-Darcy flow coefficient. Two methods are generally available for the determination of these parameters; well test analysis and physical experiment. The well testing method will give more reliable results than measuring the values of permeability and non-Darcy flow coefficient on a selection of core samples and trying to average these results over the entire formation. However, for sand production prediction applications, typically, a foot-by-foot breakdown of these parameters is preferred and in some cases a finer resolution, on the order of 0.1 ft is desirable. Several experimentally derived correlations are known in the art for non-Darcy flow coefficient as a function of permeability and porosity. The following relationship is used in this method to illustrate the CDP model applications:

$$\beta = \frac{5.5 \times 10^9}{\phi_e^{0.77} k_e^{1.27}}. \tag{20}$$

Eq. 20 demonstrates that the non-Darcy flow component increases with porosity but decreases with permeability.

A continuous profile of reasonably accurate formation permeability can be estimated from nuclear magnetic resonance (NMR), acoustic and Stonley wave data logs: see Tang, X. M., Altunbay, M, and Shorey, D.: "Joint Interpretation of Formation Permeability from Wireline Acosutic, NMR and Image Log data", SPWLA, 1998. In the absence of these data, empirical relationships between permeability and various log parameters must be used. There exist several empirical relationships with which permeability can be estimated from porosity and irreducible water saturation: see Wyllie, M. R. J., and Rose, W. D.: "Some Theoretical Considerations Related to the Quantitative Evaluation of the Physical Characteristics of Reservoir Rock from Electrical Log Data", *J. Petroleum Tech.*, (April 1950) 189. A form that incorporates the effects of clay volume is used for the estimation of absolute permeability:

$$k_a^{1/2} = 100^{(1-V_{cl})} \phi_e^{2.25} \frac{(1 - S_{wir})}{S_{wir}}. \tag{21}$$

which when multiplied by the relative permeability, gives the required effective permeability for the non-Darcy flow coefficient determination. Many empirical equations for calculating relative permeabilities have been proposed, and for a gas-water system, the following well known relationship for a well-sorted sandstone formation has been adopted:

$$k_{rg} = \left(\frac{1 - S_w}{1 - S_{wir}}\right)^3 \tag{22}$$

APPLICATION EXAMPLE

Perforated Completion

Figure 5:
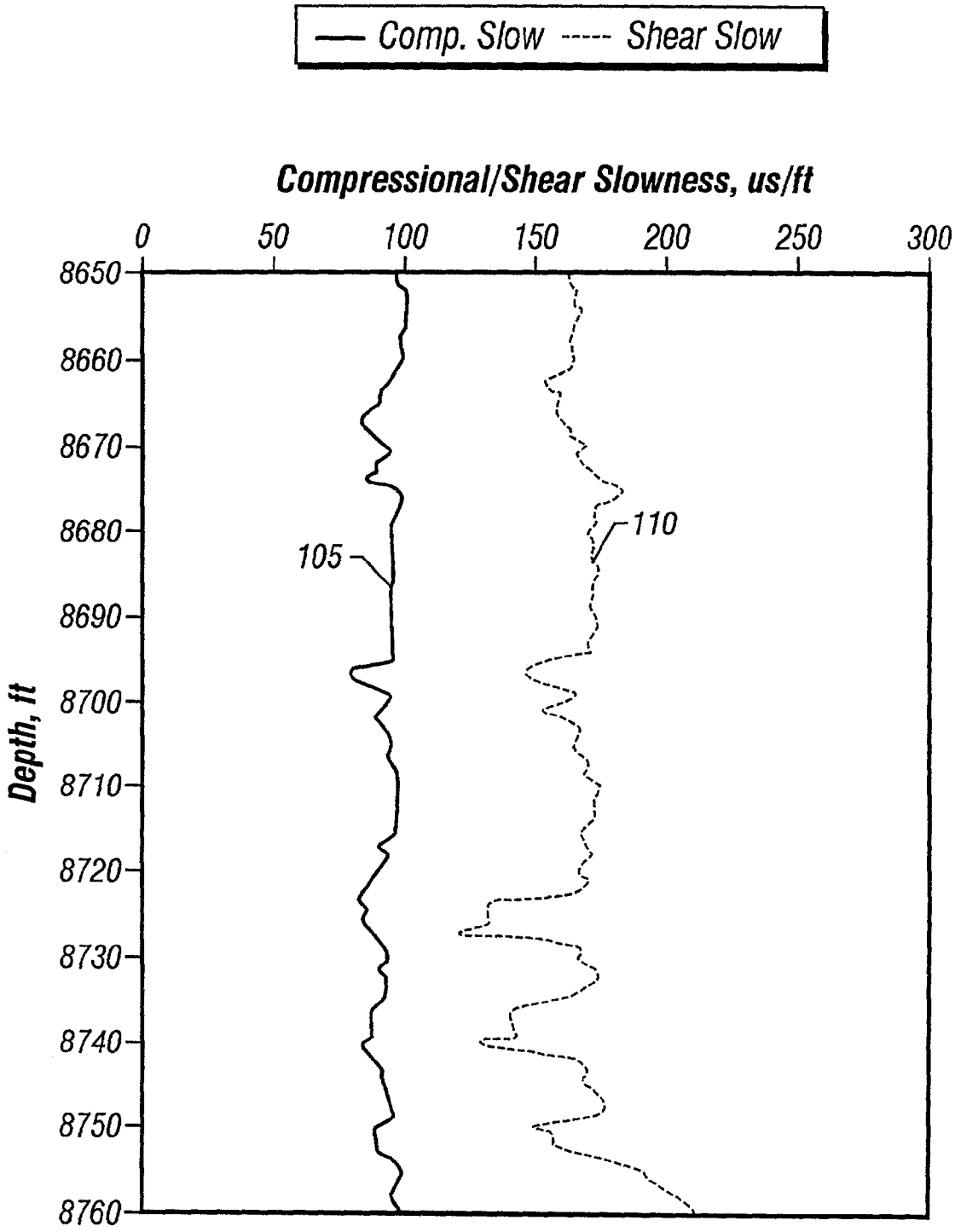
FIG. 5 is a schematic graph showing the variations of compressional and shear wave slowness logged over an example depth interval according to one embodiment of the present invention.
Figure 6:
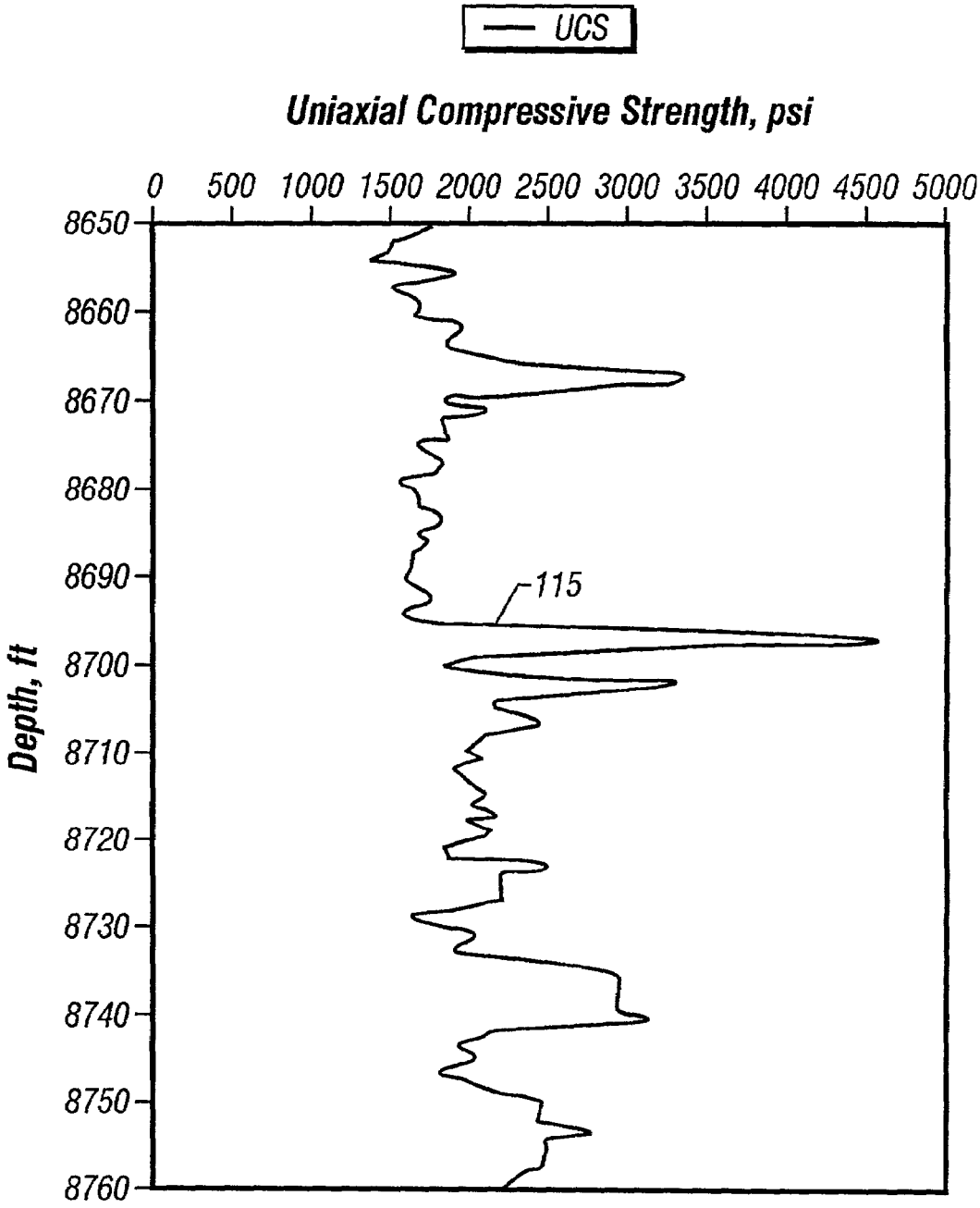
FIG. 6 is a schematic graph showing the variations of uniaxial compressive strength with depth over an example interval according to one embodiment of the present invention.

To illustrate the application methodology, log data from an example gas well is used to compute CDP. FIG. 5 shows the variations of compressional 105 and shear 110 wave slowness logged over a selected depth interval. The high compressional 105 slowness of 90–100 μs/ft suggests that the formation could be weak and sand production could become a reality at high production rates. FIG. 6 shows the variations of uniaxial compressive strength (UCS) 115 with depth predicted using LMP. The plot indicates that with the exception of a few hard streaks, the formation is of a low strength sandstone with UCS 115 generally less than 2000 psi. In such a weak but competent formation, the decision to gravel pack is not straightforward because of its high cost, which must be compared to the desired drawdown or production rate. For a high rate gas well completion, the decision is even more critical and hence a proper CDP evaluation must be carried out to optimize sand control strategies.

Figure 7:
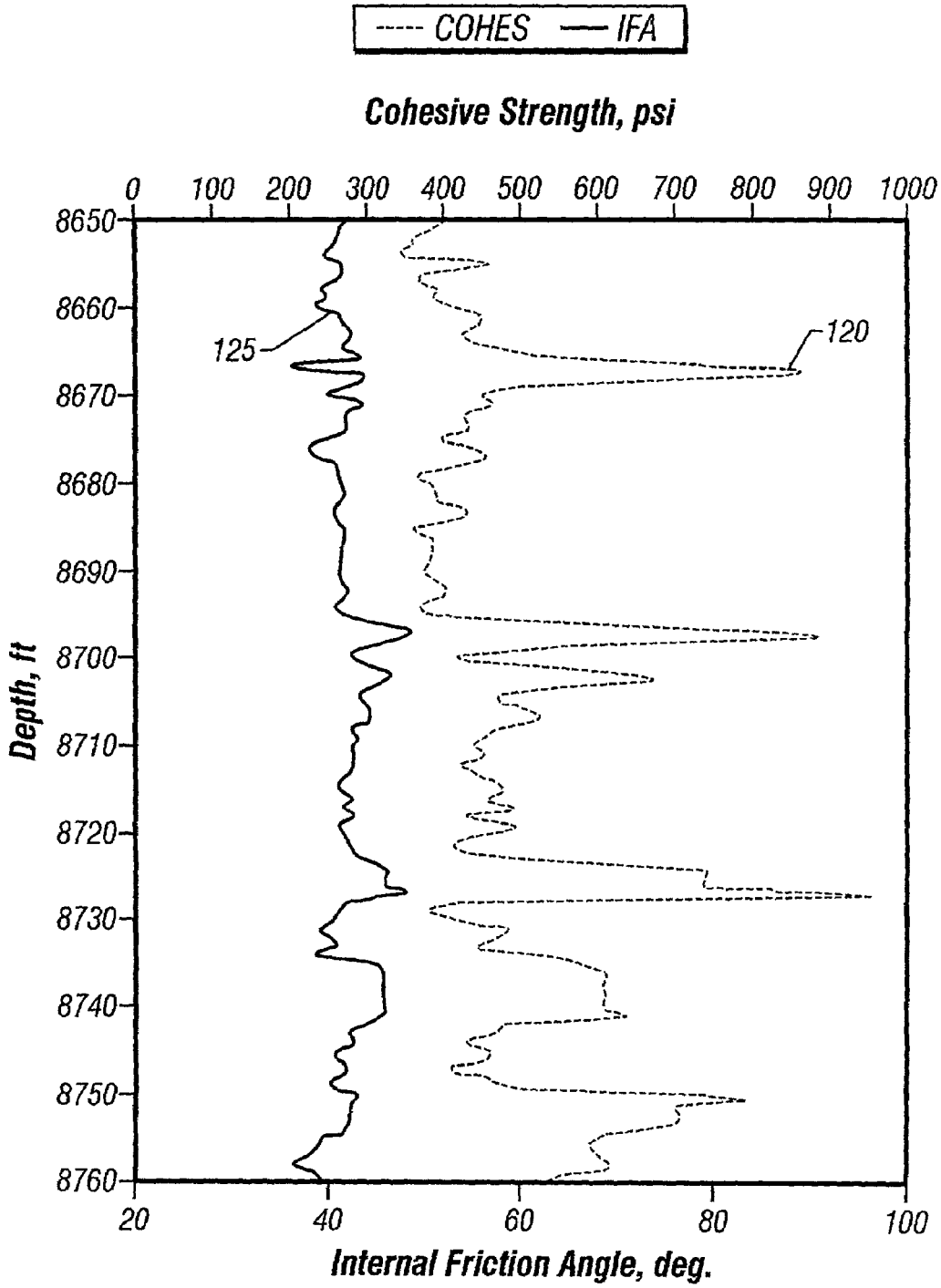
FIG. 7 is a schematic graph showing the log derived cohesive strength and internal friction angle over an example interval according to one embodiment of the present invention.
Figure 8:
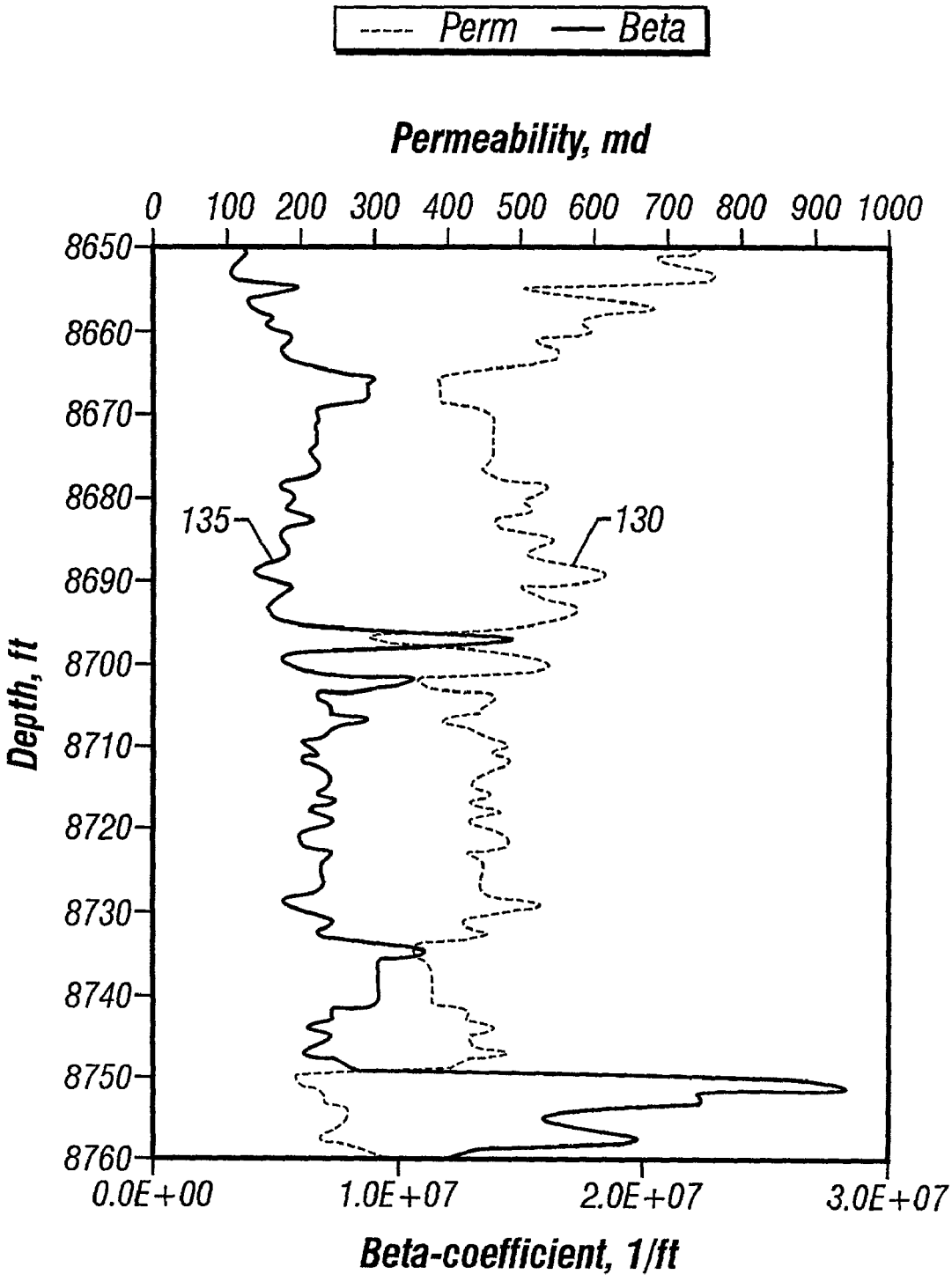
FIG. 8 is a schematic graph showing formation permeability and non-Darcy flow coefficient over an example interval according to one embodiment of the present invention.

FIG. 7 shows the log derived cohesive strength 120 and internal friction angle 125. Neglecting the hard streaks, the cohesive strength 120 averages 400 psi in the upper sand body and increases to about 450 psi in the lower unit. These relatively low cohesive strengths suggest that the formation is competent but weak, as cementation may mostly be confined at grain contacts. The internal friction angle 125 averages about 40°, indicating that the rock has a coarse and angular grain structure. As shown in FIG. 8, within the pay zone, the formation permeability 130 decreases with depth, averaging 600 md and 450 md in the upper and lower parts of the sand body, respectively. The non-Darcy flow coefficient 135 shows an increasing trend with decreasing permeability as stipulated by Eq. 21.

A spherical perforation cavity model is used to calculate the critical drawdown pressure. Although the actual perforation may be somewhat cylindrical, experience shows that much of the flow into the perforation occurs at the tip, due to both perforation damage and flow geometry. The pressure gradients are more severe for this spherical geometry compared to the cylindrical geometry for the same drawdown. With slight solids production, perforation cavities may evolve towards a more spherical shape. Using the log derived formation strength and petrophysical parameters as well as other input data summarized in FIG. 12, a critical drawdown pressure curve for gas flow that incorporates the non-Darcy coefficient is shown in FIG. 9.

Figure 9:
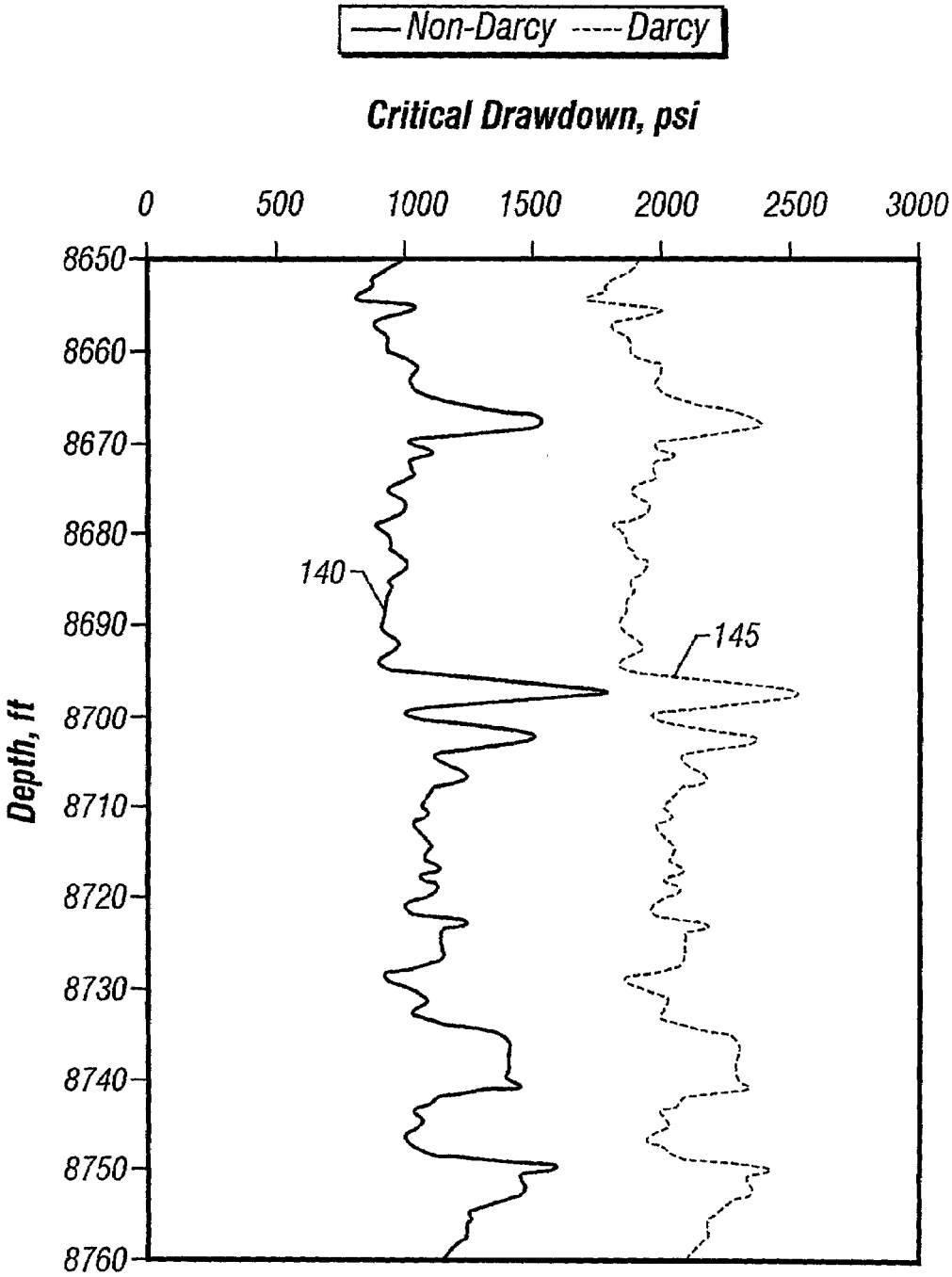
FIG. 9 is a schematic graph showing Darcy critical drawdown pressure over an example interval and a non-Darcy critical drawdown pressure, according to one embodiment of the present invention, over the same example interval.

The CDP curve for Darcy gas flow based on the following critical drawdown equation from Weingarten et al. is also included in FIG. 9 for comparison:

$$\frac{4\sin\alpha}{1-\sin\alpha} - \frac{P'_b - P'_a}{m+1}(P'_a)^{-\frac{m}{m+1}} = 0. \tag{23}$$

The figure shows that for other factors equal, the CDP 140 for a gas reservoir producing at high rates (assuming non-Darcy effect is active) is lower than the CDP 145 for a gas reservoir producing at the Darcy flow regime. The ratio of $CDP_{nD}$:$CDP_D$ is approximately 1:2, in this particular case.

In addition to providing guidelines for maximum drawdown or flow rate to avoid sand production, a continuous profile of CDP with depth is also useful for developing an optimum selective perforation strategy. In this case, the lower sand body member exhibits higher strength and CDP and should be perforated to avoid sand production if selective perforation is chosen as the most economical sand control technique.

APPLICATION EXAMPLE

Horizontal Well

Figure 10:
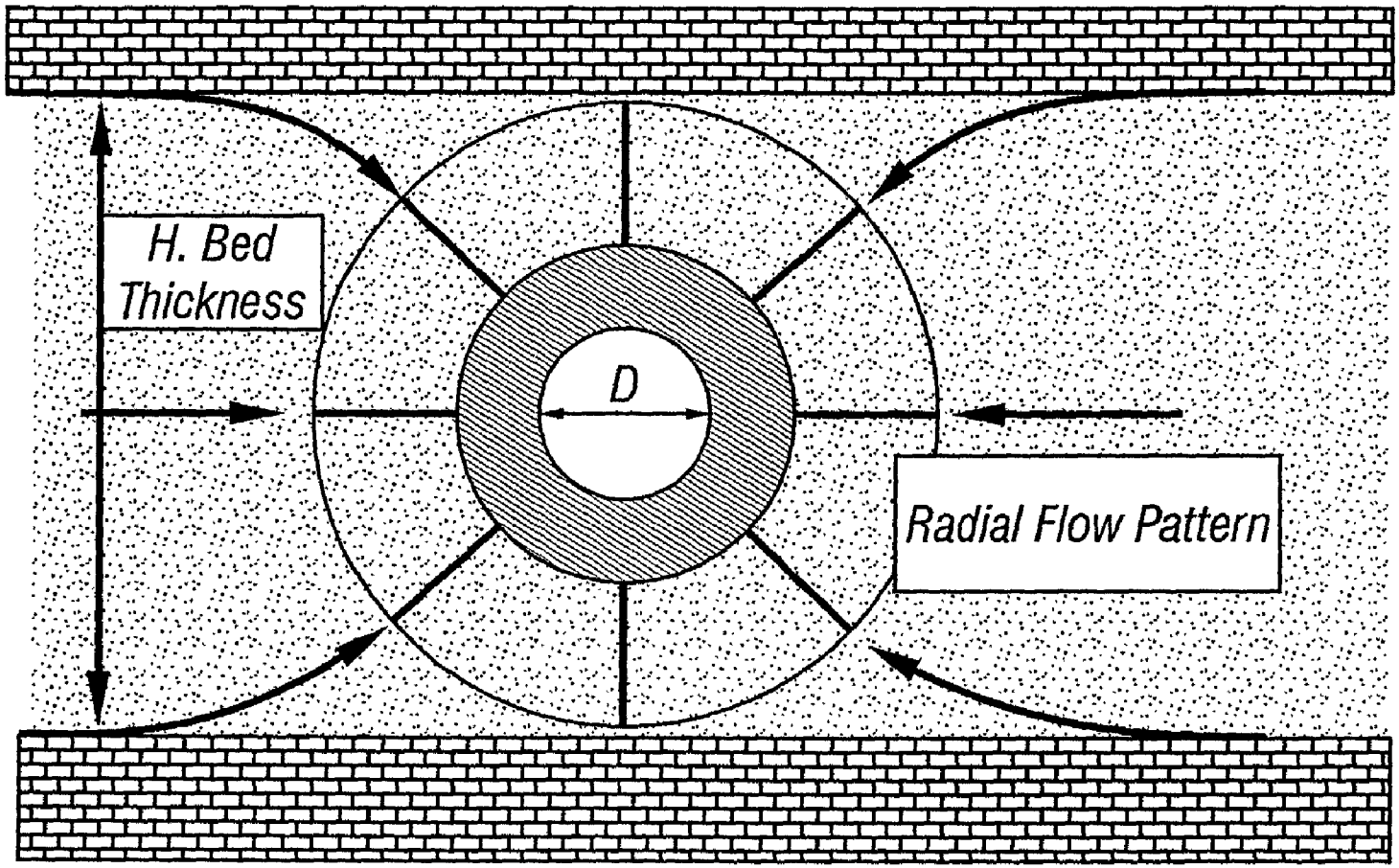
FIG. 10 is a schematic of a horizontal open hole which can be represented by a cylindrical cavity model.

Horizontal and multilateral wells are fast becoming an industry standard for wellbore construction. Among the preferred completion methods for most horizontal wells are open-holes whose sand control consists of either slotted liners of pre-pack screens. For such a completion in a weak but competent formation, the bottomhole flowing pressure must be ascertained to stay above the value dictated by the formation's critical drawdown pressure, in order to minimize the potential of sand failure. The cylindrical cavity model (CDP-OH) can be used, assuming that the well is located in a homogeneous reservoir of height H and bounded by impermeable layers, as shown in FIG. 10. For such a configuration, the flow will be cylindrically symmetric up to the radial distance of roughly H/2 and becomes uniform with increasing distance (>H/2) from the wellbore: see Ramos, G. G., Katahara, K. W., Gray, J. D., and Knox, D. J. W.: "Sand Production in Vertical and Horizontal Wells in a Friable Sandstone Formation, North Sea", Eurock '94, 1994. To illustrate this application, data from the previous example are used to calculate CDP-OH for both open-hole slotted liner (cylindrical cavity) and perforated (spherical cavity) completions.

Figure 11:
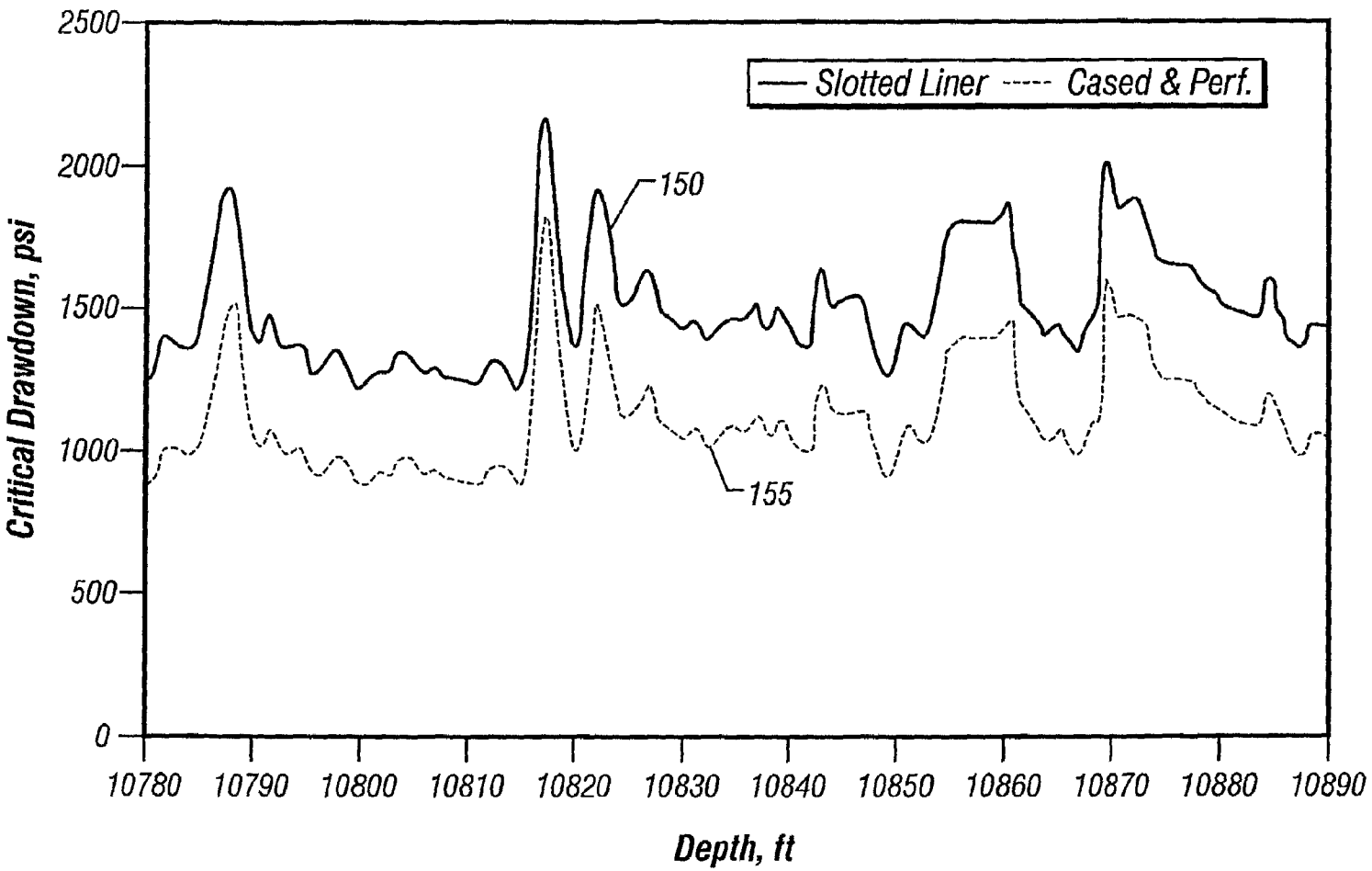
FIG. 11 is a schematic graph of critical drawdown pressure for a slotted liner completion, according to one embodiment of the present invention, and critical drawdown pressure for a cased and perforated completion, according to one embodiment of the present invention.

FIG. 11 shows that slotted liner completion has CDP 150 in the range of about 350–400 psi higher than the CDP 155 corresponding to a cased and perforated completion over the zone of interest. From a sand production mitigation point of view, this observation is important not only for its ease of installation, but the slotted liner also affords an increase in allowable drawdown. With continued production, compaction induced stresses caused by reservoir depletion and water encroachment are two factors that may trigger wellbore instability and the on-set of sand production. If this occurred, the slotted liner would help to maintain stability by limiting rock plastic deformations.

| Nomenclature |
|---|
| a = radius of cavity |
| b = external drainage radius |
| k = formation permeability |
| m = gas density exponent |
| p = pressure |
| r = radius |
| $k_a$ = absolute permeability |
| $k_e$ = effective permeability |
| $k_{rg}$ = effective permeability |
| A area |
| G = mass flow rate |
| $P_a$ = pressure at the face of the cavity |
| $P_b$ = pressure at the external flow boundary |
| $P'_a\left(\frac{P_a\tan\alpha}{S_o}\right)^{m+1}$ |
| $P'_b\left(\frac{P_b\tan\alpha}{S_o}\right)^{m+1}$ |
| $S_o$ = cohesive strength |
| $S_r$ = radial stress, total |
| $S_t$ = tangential stress, total |
| $S_w$ = water saturation |
| $S_{wi}$ = irreducible water saturation |
| $V_{cl}$ = clay volume |
| $\alpha$ = internal friction angle |
| $\beta$ = non-Darcy flow coefficient |
| $\gamma$ = gas density coefficient |
| $\mu$ = gas viscosity |
| $\phi_e$ = effective porosity |
| $\rho$ = gas density |
| $\sigma_n$ = normal stress |
| $\sigma_r$ = effective radial stress |
| $\tau$ = shear stress |

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. A method for estimating a critical drawdown pressure for a formation surrounding a well, comprising:

obtaining well log data acquired by a logging tool over a portion of the well;

estimating a mechanical parameter of the formation for a plurality of depths along the portion of the well using the obtained well log data;

estimating a formation flow parameter for the plurality depths using the obtained well log data;

estimating a plurality of non-Darcy flow coefficients for the plurality of depths using the formation flow parameter;

estimating a formation gas parameter; and estimating the critical drawdown pressure for the formation surrounding the well for each of the plurality of depths using the mechanical parameter, gas parameter and the non-Darcy flow coefficients.

2. The method of claim 1, wherein the mechanical parameter comprises at least one of (i) rock cohesive strength, (ii) uniaxial compressive strength, and (iii) internal friction angle.

3. The method of claim 1, wherein the formation flow parameter comprises at least one of (i) permeability and (ii) porosity.

4. The method of claim 1, wherein the formation gas parameter comprises at least one of (i) gas density, (II) gas viscosity, (iii) gas density coefficient, and (iv) gas density exponent.

5. The method of claim 1, wherein the formation flow parameter is estimated on a predetermined depth interval.

6. The method of claim 1, wherein the formation gas parameter is estimated from at least one of (i) an experimental test of a gas sample, and (ii) a correlative chart.

7. The method of claim 1 further comprising: presenting a critical drawdown pressure verses depth in a table of numerical data.

8. The method of claim 1 further comprising: presenting a critical drawdown pressure verses depth as a graphical log.

9. A method of completing a well, comprising:

a. obtaining a well log data acquired by a logging tool;

b. estimating a mechanical parameter of the formation for a plurality of depths using the well log data;

c. estimating a formation flow parameter for the plurality of depths using the well log data;

d. estimating a using the formation flow parameter;

e. estimating a formation gas parameter;

f. estimating a critical drawdown for the plurality of depths using the mechanical parameter, gas parameter and non-Darcy flow coefficients; and g. selecting a well completion technique for completing the well that utilizes highest critical drawdown pressure in for the plurality of depths.

10. The method of claim 9, wherein the well completion technique is one of (i) a cased and perforated completion, and (ii) a slotted liner completion.

11. The method of claim 1 further comprising: completing the well based on the estimated critical drawdown pressure.

12. The method of claim 1 further comprising: choosing a well completion technique including perforating the well based on the estimated critical drawdown pressure.

* * * * *